US006129398A

United States Patent [19]

Calhoun

[11] Patent Number: 6,129,398

[45] Date of Patent: Oct. 10, 2000

[54] SMOKELESS TOBACCO RETRIEVAL DEVICE

[76] Inventor: Timothy W. Calhoun, 331 Company Farm Rd., Baskin, La. 71219

[21] Appl. No.: 09/421,339

[22] Filed: Oct. 18, 1999

[51] Int. Cl.[7] ..... B25B 9/02

[52] U.S. Cl. ..... 294/99.2; 294/25

[58] Field of Search ..... 294/1.1, 16, 25, 294/33, 50.7, 50.8, 99.2, 106; 131/238, 242, 250, 257, 258, 329; 206/236, 238, 242, 223; 222/344

[56] References Cited

U.S. PATENT DOCUMENTS

| | | | |
|---|---|---|---|
| D. 157,104 | 1/1950 | Tuttle et al. | 294/99.2 X |
| 1,250,422 | 12/1917 | Bohlman | 294/99.2 |
| 1,515,000 | 11/1924 | Thompson | 294/1.1 |
| 1,806,441 | 5/1931 | Bauer et al. | 294/99.2 |
| 2,049,298 | 7/1936 | Jung | 294/50.7 X |
| 3,889,995 | 6/1975 | Lin | 294/99.2 |
| 3,934,915 | 1/1976 | Humpa | 294/16 |
| 3,977,410 | 8/1976 | Huston et al. | 294/99.2 X |
| 4,261,608 | 4/1981 | Bradshaw | 294/99.2 X |
| 4,286,514 | 9/1981 | Wilson | 294/99.2 X |
| 4,728,139 | 3/1988 | Oretti | 294/99.2 |
| 4,768,288 | 9/1988 | Culbertson | 294/33 X |
| 4,877,280 | 10/1989 | Milano | 294/99.2 |
| 5,147,368 | 9/1992 | Brown | 294/99.2 X |
| 5,649,728 | 7/1997 | Warthen | 294/16 |
| 5,795,002 | 8/1998 | Boron | 294/99.2 |

FOREIGN PATENT DOCUMENTS

| | | | |
|---|---|---|---|
| 1159826 | 2/1958 | France | 294/99.2 |

*Primary Examiner*—Johnny D. Cherry
*Attorney, Agent, or Firm*—Henderson & Sturm LLP

[57] ABSTRACT

A loose tobacco retrieval device 10 for removing a portion of a quantity of loose tobacco 101 from a conventional loose tobacco receptacle 100. The retrieval device 10 includes an elongated handle member 20 having a flexible hinge 21 and a pair of handle arms 22 each provided with a tab element 23. The outboard ends of each handle arm 22 are provided with scoop members 30 adapted to captively engage a portion of the quantity of loose tobacco 101 from the conventional loose tobacco receptacle 100.

13 Claims, 1 Drawing Sheet

SMOKELESS TOBACCO RETRIEVAL DEVICE

BACKGROUND OF THE INVENTION

1. Field of the Invention

The present invention relates to the field of tong style grasping devices in general, and in particular to a specialized smokeless tobacco retrieval device based on the tong principles.

2. Description of Related Art

As can be seen by reference to the following U.S. Pat. Nos. 3,934,915; 3,977,410; 4,728,139; 5,649,728; and 5,795,002, the prior art is replete with myriad and diverse hinged handle devices used for a variety of purposes.

While all of the aforementioned prior art constructions are more than adequate for the basic purpose and function for which they have been specifically designed, they are uniformly deficient with respect to their failure to provide a simple, efficient, and practical device that can be employed to remove smokeless tobacco from pouches and tins in a relatively hygienic fashion.

As most users of smokeless tobacco are all too well aware, there are many instances when the enjoyment of this product must be delayed or postponed due to the fact that the user's hands are soiled by dirt, grease, etc. which would be transferred directly to the tobacco thereby substantially lessening the enjoyment of the product, as well as representing potential health problems.

As a consequence of the foregoing situation, there has existed a longstanding need for a new and improved smokeless tobacco retrieval device that will permit the user to retrieve the tobacco from a tin or pouch even when their hands are not the cleanest, and the provision of such a construction is a stated objective of the present invention.

BRIEF SUMMARY OF THE INVENTION

Briefly stated, the smokeless tobacco retrieval device comprises in general, a hinged handle unit having scoop units formed on the opposite ends of the hinged handle unit. The retrieval device is dimensioned to fit inside a conventional receptacle for smokeless tobacco such as a tobacco tin or tobacco pouch.

As will be explained in greater detail further on in the specification, the hinged handle unit comprises a handle member provided with a pair of mirror image handle arms that are hingedly associated with one another. Each of the handle arms is provided with an upwardly projecting gripping tab that can be employed for a variety of purposes.

For instance, the gripping tab can be used to remove the device from a quantity of tobacco contained within a conventional loose tobacco receptacle, such as a tin or pouch. Furthermore, the tabs are provided to enhance the user's grip on the handle arms and may further be provided with discrete apertures such that either one or both of the handle arms can be attached to a key chain or the like for transporting the retrieval device independently of a loose tobacco receptacle.

In addition, each of the scoop units comprises a scoop member having a generally elongated spoon shaped configuration. The sides of each scoop member are recessed such that a gap exists between the scoop members even if the outboard ends of the scoop members are brought into contact with one another.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
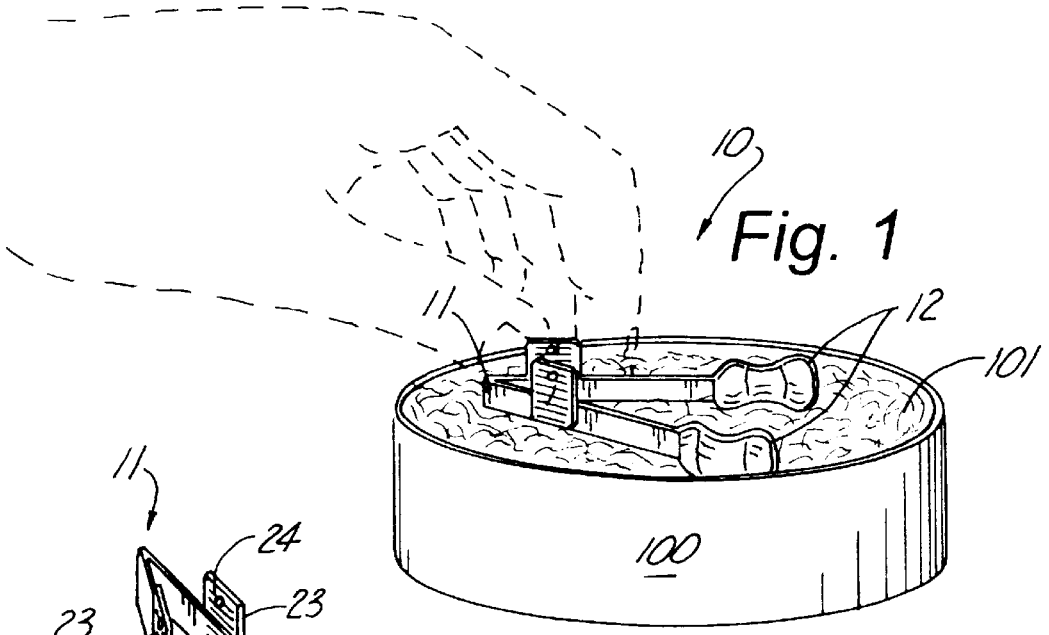
FIG. 1 is a perspective view of the smokeless tobacco retrieval device being employed in a loose tobacco receptacle.

As can be seen by reference to the drawings, and in particular to FIG. 1, the smokeless tobacco retrieval device that forms the basis of the present invention is designated generally by the reference number 10. The retrieval device 10 comprises in general, a hinged handle unit 11 provided with a pair of scoop units 12. These units will now be described in seriatim fashion.

Figure 2:
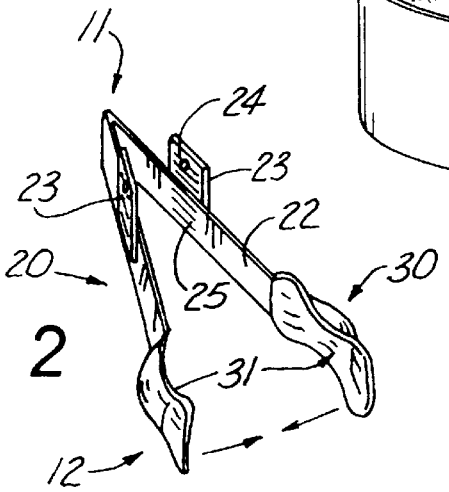
FIG. 2 is an isolated perspective view of the retrieval device in the partially closed position.
Figure 3:
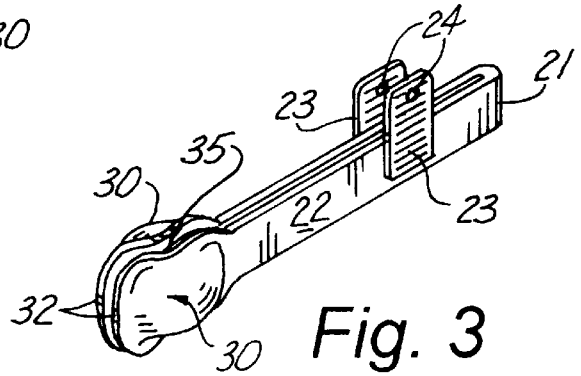
FIG. 3 is a side elevation view of the interior surface of the retrieval device in the fully open position.

As can best be seen by reference to FIGS. 2 and 3, the hinged handle unit 11 comprises an elongated handle member 20 having an intermediate flexible hinge joint 21 which connects two identical handle arms 22, 22. Each handle arm 22 is provided with an upwardly projecting tab element 23.

In addition, each of the tab elements 23, 23 is provided with a discrete aperture 24 whose purpose and function will be described in greater detail further in the specification. The external faces of the tab elements 23, 23 and that area of the handle arms 22, 22 beneath the tab elements 23, 23 are provided with friction ridges 25 to enhance the user's grasp of the retrieval device 10.

Figure 4:
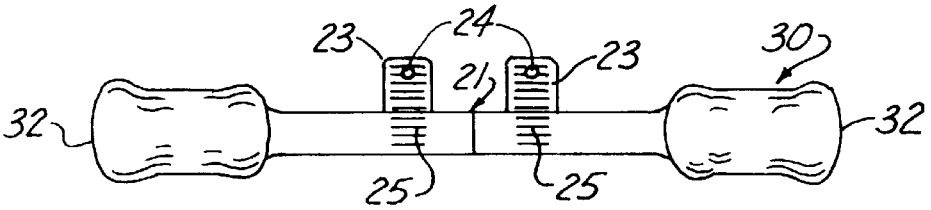
FIG. 4 is a top plan view of the retrieval device in the fully open position.
Figure 5:
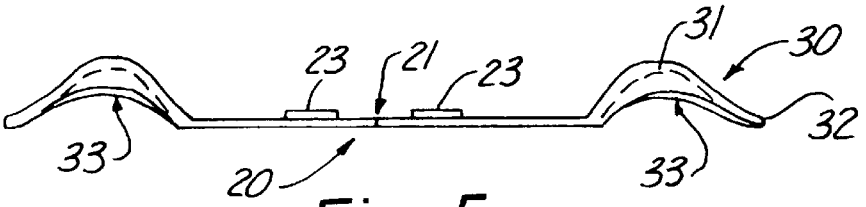
FIG. 5 is a top plan view of the retrieval device in the fully closed position.

As shown in FIGS. 2 through 5, each of the scoop units 12 comprises a generally spoon shaped scoop member 30 having a concave inner face 31 and an enlarged spatulate outer end 32. The opposed sides 33 of the scoop members 30 are recessed as shown in FIGS. 2 and 4 such that an opening 35 is defined by the recessed sides 33 when the scoop members 30 are brought together as shown in FIG. 5.

In the preferred embodiment of the invention depicted in the drawings, the retrieval device 10 would be dimensioned to easily fit in the folded position within a conventional loose tobacco receptacle 100 such as a tobacco tin shown in FIG. 1 or a tobacco pouch (not shown).

As a consequence, in the embodiment shown in FIG. 1, the flattened or linear length of the retrieval device would be approximately 4 ½ inches. The folded effective length of the retrieval device as disposed within a tobacco tin would be 2 ¼ inches.

Obviously, in instances wherein the retrieval device 10 would be provided in a tobacco pouch, the dimensions of the device 10 could be enlarged as long as the folded effective length of the retrieval device could be easily accommodated within a conventional loose tobacco receptacle 100.

It should also be appreciated that in the preferred embodiment of the invention, the device 10 would be fabricated from plastic or other suitable flexible material having a smooth, washable, non-porous surface.

As mentioned previously, the retrieval device 10 is designed and intended to ideally be pre-packaged in loose tobacco receptacle 100. When the user opened the tobacco receptacle 100, either or both of the tab elements 23 would project above the level of the loose tobacco 101 to allow the user to extract the retrieval device 10 from the receptacle without their fingers coming into contact with either of the scoop members 30.

The user would then grasp the ribbed tab elements 23 and the adjacent portions of the handle arms 32 to captively engage a quantity of the loose tobacco in a pincer fashion between the scoop members 30. The opening 35 defined by the recessed sides 33 of each scoop element 30 will permit a greater quantity of loose tobacco 101 to be captively engaged between the scoop members 30 when the tips of the scoop members 30 come into contact with one another.

As was also mentioned previously, the discrete aperture 24 that is formed in each tab element 23 is provided to allow the device 10 to be suspended from a key chain tether, or the like that could be threaded through either one or both of the tab elements 23 in a well recognized fashion for transport on the user's person.

It should also be noted that this invention also appreciates the fact that some users of this retrieval device 10 would desire a more durable construction than that provided by plastic and this invention also envisions a metal version. The opening 35 between the recessed sides 33 of the scoop members 30 becomes even more important to prevent the unintentional severing of a portion of the loose tobacco that is captively engaged between the scoop members 30.

As can also be appreciated by reference to the drawings, the retrieval device 10 is intended to be fabricated as a one piece construction wherein all of the structural components are formed integrally with one another.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A retrieval device for removing a quantity of loose tobacco from a selected loose tobacco receptacle which includes a tobacco tin and a tobacco pouch wherein the retrieval device comprises:

a hinged handle unit including an elongated handle member having opposite ends and including a pair of handle arms which are connected by a flexible hinge formed intermediate the opposite ends of the handle member;

a pair of scoop units wherein each scoop unit is formed on one of the ends of the handle member and comprises a generally spoon shaped scoop member; and at least one tab element provided on the elongated handle member wherein the at least one tab element projects upwardly from one of the handle arms, and is provided with a ridged friction surface and an aperture.

2. The retrieval device as in claim 1 wherein said ridged friction surface extends downwardly onto said one of the handle arms.

3. The retrieval device as in claim 1 wherein each of the scoop members has a central recess and a spatulate outboard end.

4. The retrieval device as in claim 1 wherein each of the scoop members has a central recess and opposed recessed sides.

5. The retrieval device as in claim 4 wherein said opposed recessed sides define an opening when said scoop members are brought into contact with one another.

6. The retrieval device as in claim 1 wherein each of the handle arms is provided with a tab element which projects upwardly from each handle arm.

7. The retrieval device as in claim 6 wherein at least one of the tab elements is provided with an aperture.

8. The retrieval device as in claim 6 wherein both of the tab elements are provided with an aperture.

9. The retrieval device as in claim 6 wherein both of the tab elements are provided with a ridged friction surface.

10. The retrieval device as in claim 6 wherein each of the scoop members has a central recess and a spatulate outboard end.

11. The retrieval device as in claim 6 wherein each of the scoop members has a central recess and opposed recessed sides.

12. The retrieval device as in claim 6 wherein each of the scoop members has a central recess, opposed recessed sides and a spatulate outboard end.

13. The retrieval device as in claim 6 wherein the handle unit, the pair of scoop units, and the pair of tab elements are formed integrally with one another.

* * * * *